US007637041B2

(12) United States Patent
Pan et al.

(10) Patent No.: US 7,637,041 B2
(45) Date of Patent: Dec. 29, 2009

(54) ELECTRIC IRON

(75) Inventors: Chih-Jung Pan, Taipei (TW); Wan-Hua Wu, Taipei (TW); Ching-Ching Ho, Taipei (TW); Yi-Hao Lin, Taipei (TW); Chun-Hsien Wu, Taipei (TW)

(73) Assignee: Tsann Kuen Enterprise Co., Ltd., Taipei (TW)

( * ) Notice: Subject to any disclaimer, the term of this patent is extended or adjusted under 35 U.S.C. 154(b) by 8 days.

(21) Appl. No.: 12/007,407

(22) Filed: Jan. 10, 2008

(65) Prior Publication Data

US 2008/0168687 A1 Jul. 17, 2008

(30) Foreign Application Priority Data

Jan. 17, 2007 (TW) ..... 96101808 A

(51) Int. Cl.
*D06F 75/38* (2006.01)
*D06F 75/30* (2006.01)

(52) U.S. Cl. ..... 38/93; 38/88

(58) Field of Classification Search ..... 38/80, 38/81, 88, 91, 93; 219/245
See application file for complete search history.

(56) References Cited

U.S. PATENT DOCUMENTS 2,637,125 A * 5/1953 Roberts ..... 38/77.9
2,738,603 A * 3/1956 Towne ..... 38/97
3,793,753 A * 2/1974 Engelbart ..... 38/77.6
3,905,138 A * 9/1975 Abolafia ..... 38/97
4,089,128 A * 5/1978 Baumgartner et al. ..... 38/93
4,122,615 A * 10/1978 Baumgartner et al. ..... 38/93
5,651,201 A * 7/1997 Farley ..... 38/88
6,438,876 B2 * 8/2002 Har et al. ..... 38/77.7
6,513,269 B2 * 2/2003 Kobayashi et al. ..... 38/93
7,121,024 B1 * 10/2006 Clevenberg ..... 38/71

* cited by examiner

*Primary Examiner*—Ismael Izaguirre
(74) *Attorney, Agent, or Firm*—Schmeiser, Olsen & Watts LLP

(57) ABSTRACT

An electric iron in accordance with a preferred embodiment includes a housing body, a carrying base, and a flexible soleplate. The carrying base is mounted on the bottom of the housing body to define a containing space configured for receiving inner members and a controlling circuit of the electric iron. The flexible soleplate is arranged under the carrying base and transforms an electric energy transmitted from the controlling circuit to a heat energy for generating the high temperature on the surface thereof to perform an ironing function. The electric iron has the flexible soleplate, which has a high heating and dissipating-heat property and a low power property so as to decrease the consume of the electric energy and the whole weight of the electric iron.

9 Claims, 3 Drawing Sheets

ELECTRIC IRON

BACKGROUND OF THE INVENTION

1. Field of the Invention

The present invention relates to electric iron, and more particularly to an electric iron having a flexible soleplate instead of a soleplate comprised of heating pipes wrapped in an aluminum alloy.

2. Description of the Related Art

The early ironing devices were made of cast iron and had a funnel shape having charcoals burning therein, such that the ironing devices were named as irons. In the early of the twenty century, the first electric iron is was invented by E. Richard of the American and widely used so as to change a tradition which the electric energy was only supplied in the evening, and to accelerate the other household electrical appliances in selling. Therefore, the house electrical appliances of the America are thought to originate from the electric iron.

The electric irons can be divided into four kinds under their structures and functions, those are, general electric irons, thermostatic electric irons, steam electric irons, and spray electric irons. The general electric irons are a carrying base mode of the electric irons, and have a simple structure. The general electric irons include a soleplate, a heat member, a pressing plate, a housing body, and a handle, etc. The general electric irons cannot adjust the temperatures so as to eliminate gradually. The thermostatic electric irons are manufactured by adding a thermostat on the generally electric irons. The thermostat includes a bimetallic strip and a knob configured for adjust the initial distance and the press between the static contact and the dynamic contact of the bimetallic strip to obtain the needing temperature. The temperature which can be adjusted, is generally in a range of 60~250 degrees centigrade. The steam electric irons are manufactured by adding a steam generator and a steam control on the thermostatic electric irons so as to have double functions of thermostat and steam without spraying water by hand. The spray electric irons are manufactured by adding a spraying device on the steam electric irons so as to have functions of thermostat, steam, and spray. The spraying device is same to the steam electric irons. If the temperature of the soleplate is over than 100 degrees centigrade, the knob for spraying is pressed to open the dripping nozzles by the water controlling pole such that the water enters into the vaporizing chamber to be vaporized and is sprayed from the spraying nozzles on the soleplate.

The interface between the soleplate of the electric iron and the ironing clothes, must be very smooth to avoid the texture of the soleplate printing on the ironing clothes. The soleplate is generally made of the cast iron, which is plated and polished, or the Aluminum alloy, which is covered by a coating of polytetrafluoroethylene. The common heat member includes two kinds, one kind is manufactured by wrapping the heating thread around the mica framework, and the other kind is manufactured by enveloping the tubular heat member in the Aluminum alloy. The heat generated from the heat member, transmits to the soleplate to make the soleplate have a certain temperature so as to press and iron the clothes via contacting the ironing clothes.

However, since the soleplate and the heat member of the conventional electric iron are both made of metal alloy, the whole weight of the electric iron is high although the housing body and the handle are made of thermo plastics. Furthermore, the heat member operates by supplying the alternating current (AC) so it must connect with a plug, which is difficult to move. Because of the relation of the bulks of the soleplate and the heat member, the conventional electric iron must be heated in a period of time so as to make the soleplate obtain the needing temperature, and must be dissipated heat in a period time after using to make the soleplate reach the room temperature. The power of the conventional electric iron is generally in a range of 1000 W~1300 W, therefore, it consumes a large power.

What is needed, is to provide an electric iron with a high heating and dissipating-heat efficiency and a low power.

BRIEF SUMMARY

An electric iron in accordance with a preferred embodiment includes a housing body, a carrying base, and a flexible soleplate. The carrying base is mounted on the bottom of the housing body to define a containing space configured for receiving inner members and a controlling circuit of the electric iron. The flexible soleplate is arranged under the carrying base and transforms an electric energy transmitted from the controlling circuit to a heat energy for generating a high temperature on a surface thereof to perform an ironing function.

The present electric iron uses a flexible soleplate, which has a high heating and dissipating-heat efficiency and a low power property so as to decrease the consume of the electric energy. Furthermore, since the flexible soleplate has a flexibility of the fibre, the flexible soleplate is not prone to injure the ironing clothes. The flexible soleplate can also decrease the whole weight of the electric iron.

Other objects, advantages and novel features of the invention will become more apparent from the following detailed description when taken in conjunction with the accompanying drawings, in which:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe a preferred embodiment of the present electric iron, in detail.

Figure 1:
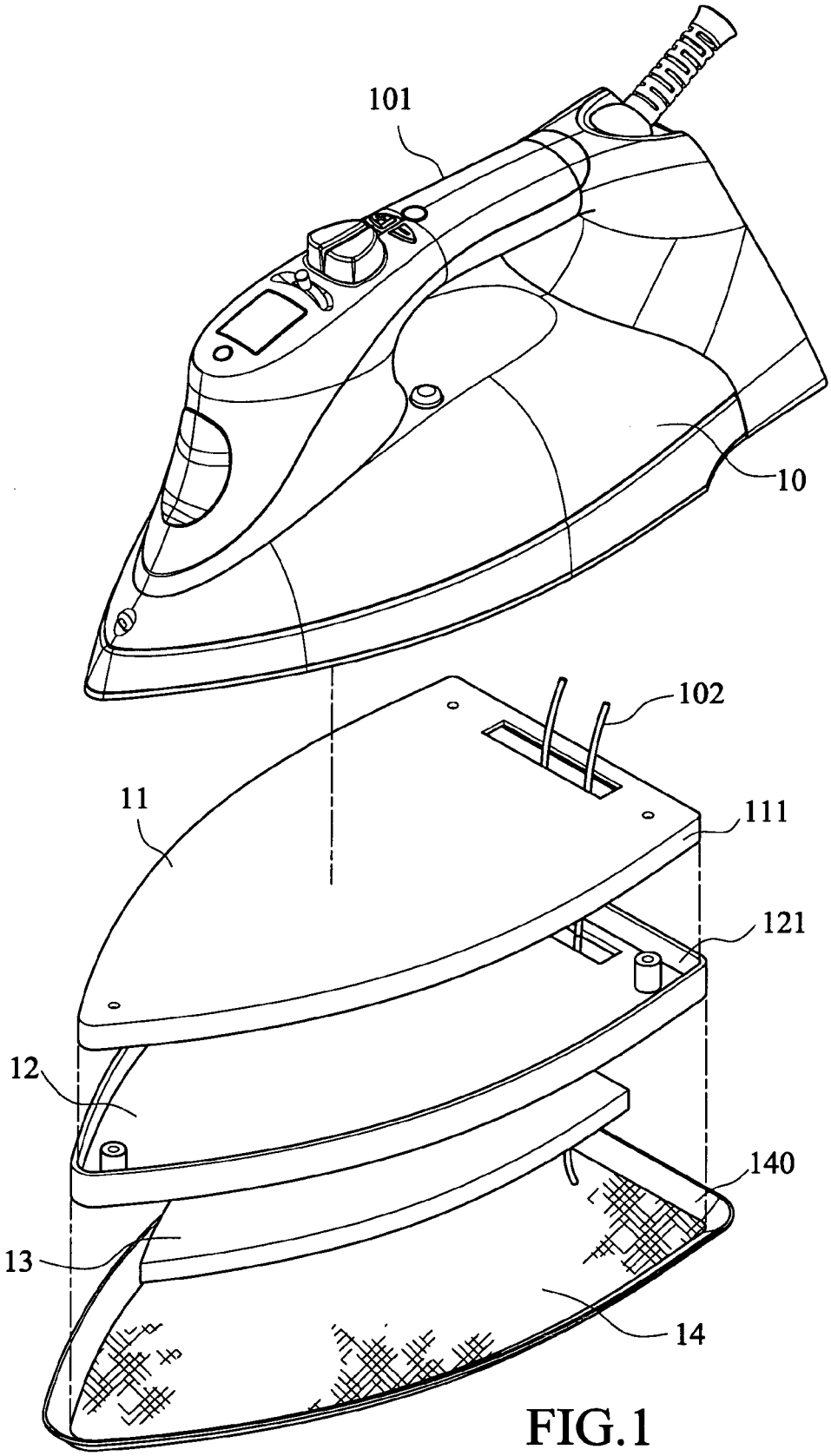
FIG. 1 is a schematic, exploded view of an electric iron in accordance with a preferred embodiment of the present invention.

Referring to FIG. 1, an electric iron in accordance with a preferred embodiment of the present invention is shown. The electric iron includes a housing body 10, a carrying base 12 and a flexible soleplate 14. The housing body 10 has a handle 101 to be configured for holding easily. The carrying base 12 is assembled in the bottom of the housing body 10 to define a containing space therein for containing inner members and a controlling circuit of the electric iron. The flexible soleplate 14 is arranged under the carrying base 12.

Figure 2:
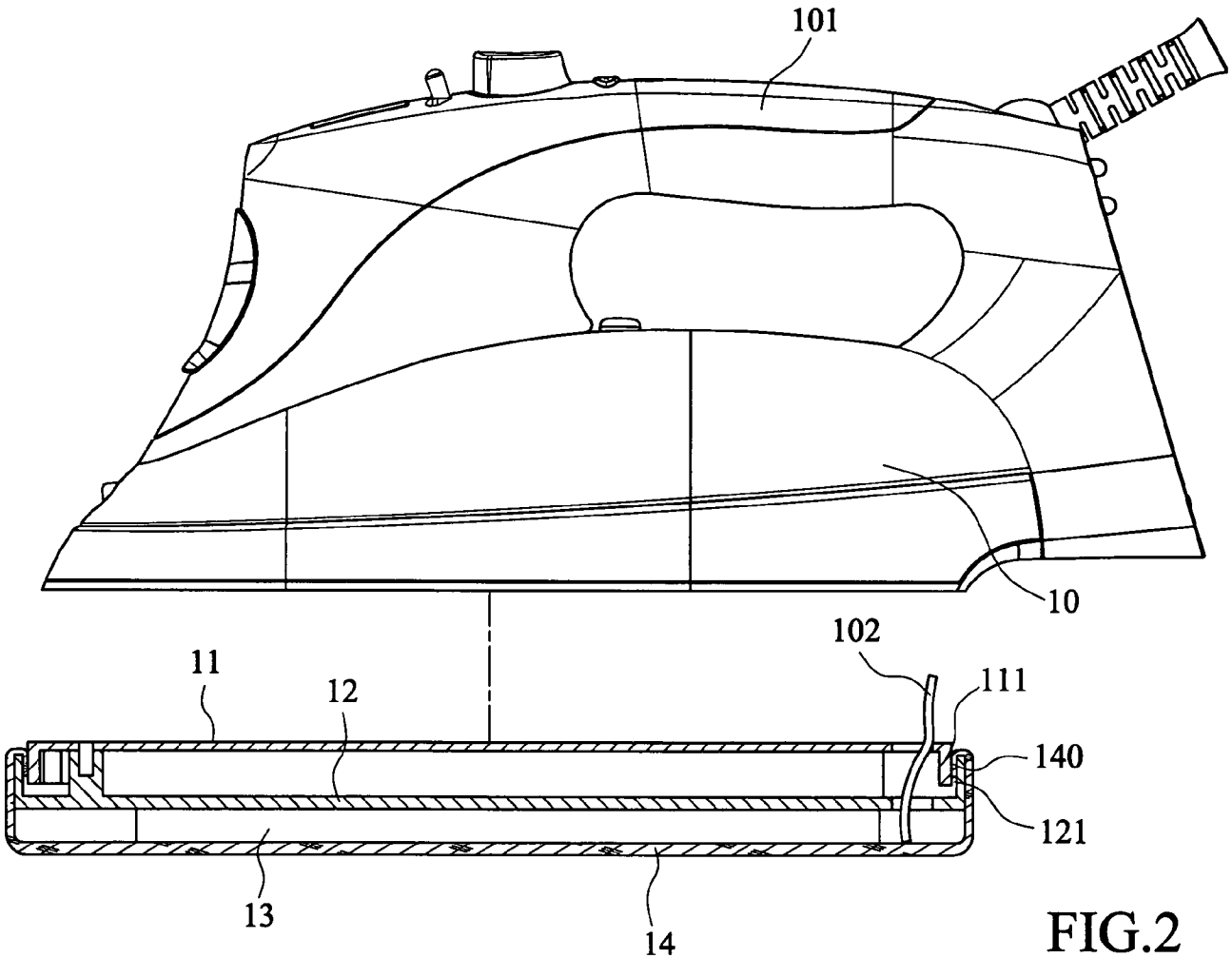
FIG. 2 is a schematic, cross-sectional view of the assembling electric iron of FIG. 1.

Referring to FIG. 2, the electric iron further includes an internal framework 11 arranged on the carrying base 12. The internal framework 11 includes an outer side 111 received in an inner side 121 of the carrying base 12 to clamp a fixing member 140 arranged in the periphery of the flexible soleplate 14. The electric iron further includes a buffer layer 13 arranged between the carrying base 12 and the flexible soleplate 14 to resist a high temperature between the flexible soleplate 14 and the carrying base 12 such that the electric iron moves more easily. The buffer layer 13 is made of ceramic wool or rock wool having high heat-resistance and compressible properties.

Figure 3:
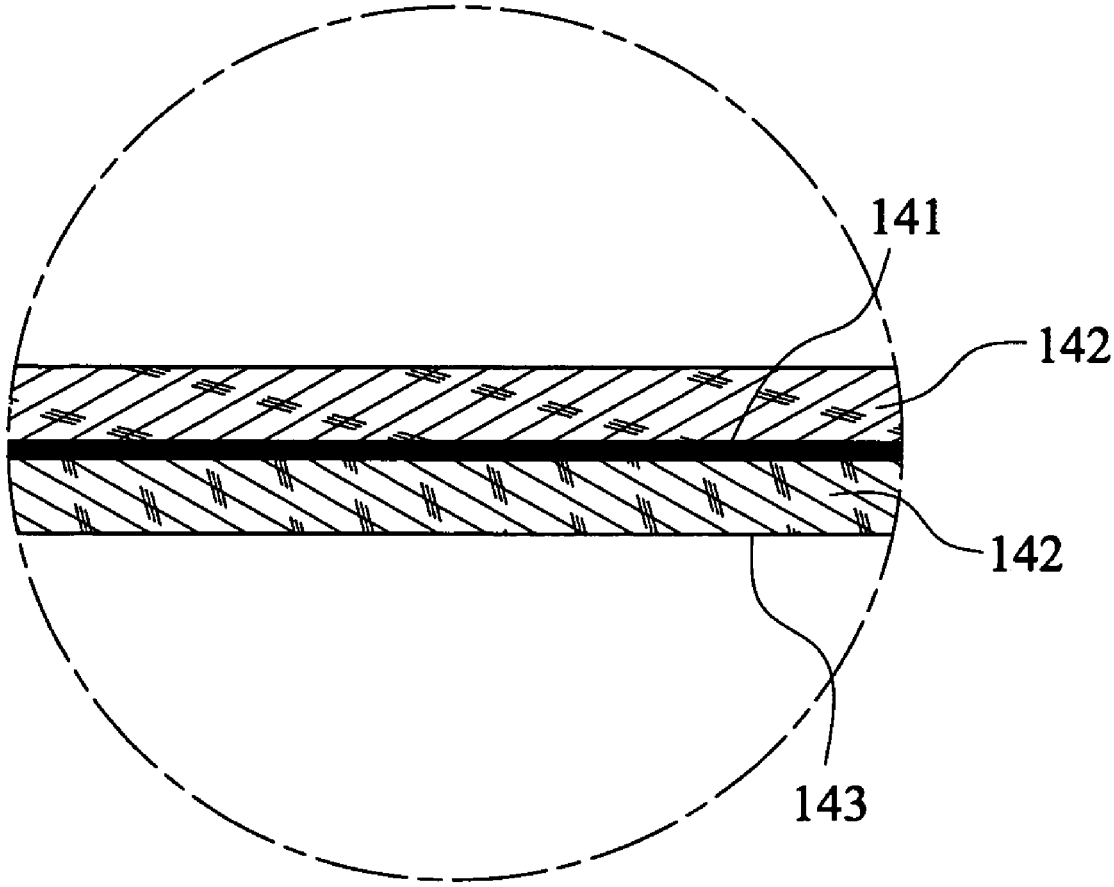
FIG. 3 is a partial-enlarged cross-section view of a heating fibre cloth of FIG. 2.

Referring to FIG. 3, the flexible soleplate 14 is made of a heating fibre cloth. The flexible soleplate 14 includes a heating fibre 141, which is connected with the controlling circuit in the housing body 10 via a lead 102 (as shown in FIGS. 1 and 2) to connect with a direct current (DC) for generating the heat energy. The heating fibre cloth further includes an abrasion resistant ironing fibre 142 covering the heating fibre 141. The heating fibre 141 is made of a material of stainless steel fibre material, and the abrasion resistant ironing fibre 142 is made of Kevlar fibre material. The Kevlar fibre is manufactured by Du Pont Company, and has property of abrasion resistance, high strong strength, and fireproofing. The heating fibre 141 is connected with the DC to generate the heat energy, and transmits the heat energy to the abrasion resistant ironing fibre 142 to generate a high temperature on the ironing fibre. Therefore, the ironing surface 143 of the soleplate 14 produces a high temperature to iron the clothes.

The heating fibre 141 is a fibre which can generate the heat energy. The heating fibre 141 is placed into a thin weave after an insulating process to form a multi-functions heater, which can not be manufactured by the conventional technologies. The heater not only has a flexibility produced by the weave, but also has an electric property produced by the metal.

Since the flexible soleplate 14 is designed to work by supplying the DC power thereon, the controlling circuit in the housing body 10 further includes an AC/DC converter module such that the electrical power can be supplied to the electric iron by the AC power. Furthermore, the electric iron of the exemplary embodiment can be operated under a voltage in a range of 12~24V, and a power in a range of 300~400 W such that it is better than the conventional electric iron, which is operated under the voltage of 100V and the power of 1000~1300 W. The heating fibre has a heating speed of 2.78 degrees centigrade per second, and a dissipating-heat speed of 5 degrees centigrade per second. The heating time of the electric iron of the exemplary embodiment is only 27 seconds from 25 degrees centigrade to 100 degrees centigrade, and it is better than the conventional electric iron, which has a heating time of 60 seconds. The electric iron of the exemplary embodiment has a dissipating-heat time of 10 seconds from 100 degrees centigrade to 50 degrees centigrade and is better than the conventional electric iron, which has a dissipating-heat time of 1440 seconds. Furthermore, in the temperature controlling, the difference in temperature of the flexible soleplate 14 is less than 10 degrees centigrade, and is better than the conventional electric iron, which has a difference in temperature of 20 degrees centigrade. The electric iron may connect directly with an AC power, and also may connect with a battery to achieve the operation without wires.

The electric iron of the exemplary embodiment uses the flexible soleplate 14 instead of the conventional soleplate. The flexible soleplate 14 has properties of high heat-conductor efficiency and low power such that it has a high heating and dissipating-heat efficiency. Furthermore, since the flexible soleplate has a flexibility of the flexible fibre material, the electric iron little injures the ironing clothes. The flexible soleplate 14 decreases the content of the metal alloy and the whole weight of the electric iron becomes lighter so as to be easy to use.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electric iron, comprising:

a housing body;

a carrying base mounted on the bottom of the housing body to define a containing space configured for receiving inner elements and a controlling circuit; and a flexible soleplate arranged under the carrying base and transforming an electric energy transmitted from the controlling circuit into a heat energy for generating a high temperature on a surface thereof to perform an ironing function;

wherein an internal framework arranged on the carrying base, and an outer side of the internal framework being received on an inner side of the carrying base for clamping the periphery of the flexible soleplate;

wherein the flexible soleplate comprises a heating fibre cloth, and the heating fibre cloth comprises a heating fibre for receiving the electric energy transmitted from the controlling circuit, and an abrasion resistant ironing fibre used for covering the heating fibre;

wherein the heating fibre is made of stainless steel fibre material;

wherein the abrasion resistant ironing fibre is made of an abrasion resistant fibre material to prevent from abrading the ironed clothes;

wherein the heating fibre is connected with a direct current (DC) for generating the heat energy;

wherein the heating fibre is connected with a battery for generating the heat energy.

2. The electric iron as claimed in claim 1, wherein the heating fibre is connected with a direct current (DC) for generating the heat energy.

3. The electric iron as claimed in claim 1, wherein the heating fibre is connected with a battery for generating the heat energy.

4. The electric iron as claimed in claim 1, further comprising a buffer layer arranged between the carrying base and the flexible soleplate.

5. The electric iron as claimed in claim 4, wherein the buffer layer is made of one of ceramic wool and rock wool.

6. The electric iron as claimed in claim 1, further comprising an AC/DC converter module connected with the controlling circuit.

7. The electric iron as claimed in claim 1, wherein the electric iron is operated under a voltage in the range of 12 to 24V.

8. The electric iron as claimed in claim 1, wherein the electric iron is operated under a power in the range of 300 to 400 W.

9. The electric iron as claimed in claim 1, wherein the electric iron is connected with an AC power.

* * * * *